US005621984A

United States Patent [19]

Hsieh

[11] Patent Number: 5,621,984

[45] Date of Patent: Apr. 22, 1997

[54] AMUSEMENT FOOTWEAR HAVING A RESILIENT SOLE

[76] Inventor: Frank Hsieh, 9th-1 Floor, Kuang Fu South Road, Taipei, Taiwan

[21] Appl. No.: 511,625

[22] Filed: Aug. 7, 1995

[51] Int. Cl.[6] ..... A43B 13/18; A43B 3/26

[52] U.S. Cl. ..... 36/28; 36/27; 36/7.8; 36/97

[58] Field of Search ..... 36/28, 27, 7.8, 36/38, 97, 115

[56] References Cited

U.S. PATENT DOCUMENTS

| | | | |
|---|---|---|---|
| 1,513,338 | 10/1924 | Menefee et al. | 36/7.8 |
| 1,566,513 | 12/1925 | Thackery | 36/7.8 |
| 2,700,832 | 1/1955 | Slovinski | 36/97 X |
| 3,996,677 | 12/1976 | Reina | 36/7.8 |
| 4,133,086 | 1/1979 | Brennan | 36/7.8 |

FOREIGN PATENT DOCUMENTS

| | | | |
|---|---|---|---|
| 466770 | 1/1969 | Switzerland | 36/7.8 |
| 466357 | 5/1937 | United Kingdom | 36/7.8 |

*Primary Examiner*—Ted Kavanaugh
*Attorney, Agent, or Firm*—Browdy and Neimark

[57] ABSTRACT

An amusement footwear comprises an insole, an outsole, and a resilient portion disposed between the insole and the outsole for providing the footwear with a bouncing effect. The resilient portion comprises a plurality of coil springs which are held securely by the fitting portions of the insole and the outsole and are enclosed by a resilient casing fastened between the insole and the outsole. The insole is provided on the heel portion thereof with an adjustment device for adjusting the size of the footwear. The outsole is provided respectively on the undersides of both front and rear ends thereof with an anti-skidding device. The footwear is provided with a front foot-fastening strap held in the front retaining holes of a ring portion of the insole and is further provided with a rear foot-fastening strap held in the rear retaining holes of the ring portion of the insole and the retaining holes of the adjustment device.

6 Claims, 3 Drawing Sheets

AMUSEMENT FOOTWEAR HAVING A RESILIENT SOLE

FIELD OF THE INVENTION

The present invention relates generally to a footwear, and more particularly to a shoe having an improved resilient sole.

BACKGROUND OF THE INVENTION

The conventional shoes having a resilient sole are generally provided with an elastic body disposed between the insole and the outsole thereof. Such conventional shoes as described above are generally limited in design in that they are provided respectively on the undersides of the front and the rear ends thereof with a relatively small area for making contact with the ground surface, and that they are incapable of providing their wearers with the state of balance so as to enable their wearers to keep themselves properly oriented or positioned, and further that they do not fit all foot sizes.

SUMMARY OF THE INVENTION

It is therefore the primary objective of the present invention to provide a shoe with a resilient sole which is provided respectively on the undersides of the front and the rear ends thereof with a relatively greater contact area, a better controllability and a better cushioning effect.

It is another objective of the present invention to provide a shoe which has a resilient sole and can be worn adjustably by persons having different foot sizes, or by the growing children and youngsters.

The foregoing objectives of the present invention are attained by the shoe comprising an insole, an outsole, and a resilient portion located between the insole and the outsole. The insole is provided integrally with a U-shaped ring portion which is in turn provided respectively and oppositely at both sides of the front end thereof with a front retaining hole and at both sides of the rear end thereof with a plurality of first rear retaining holes arranged in a parallel manner. The insole is further provided at the rear end thereof with a plurality of retaining portions arranged in a parallel manner. The outsole is provided respectively on the undersides of the front and the rear ends thereof with an anti-skidding piece. An adjustment piece of a U-shaped construction is provided respectively and correspondingly on both sides of the front end thereof with a second rear retaining hole. The adjustment piece is further provided on the bottom side thereof with a second retaining portion. The adjustment piece is fitted into the rear end portion of the U-shaped ring portion such that the second retaining portion is engaged with one of the first retaining portions of the insole, and that the second rear retaining hole of the adjustment piece is corresponding in location to one of the first rear retaining holes.

The foregoing objectives, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
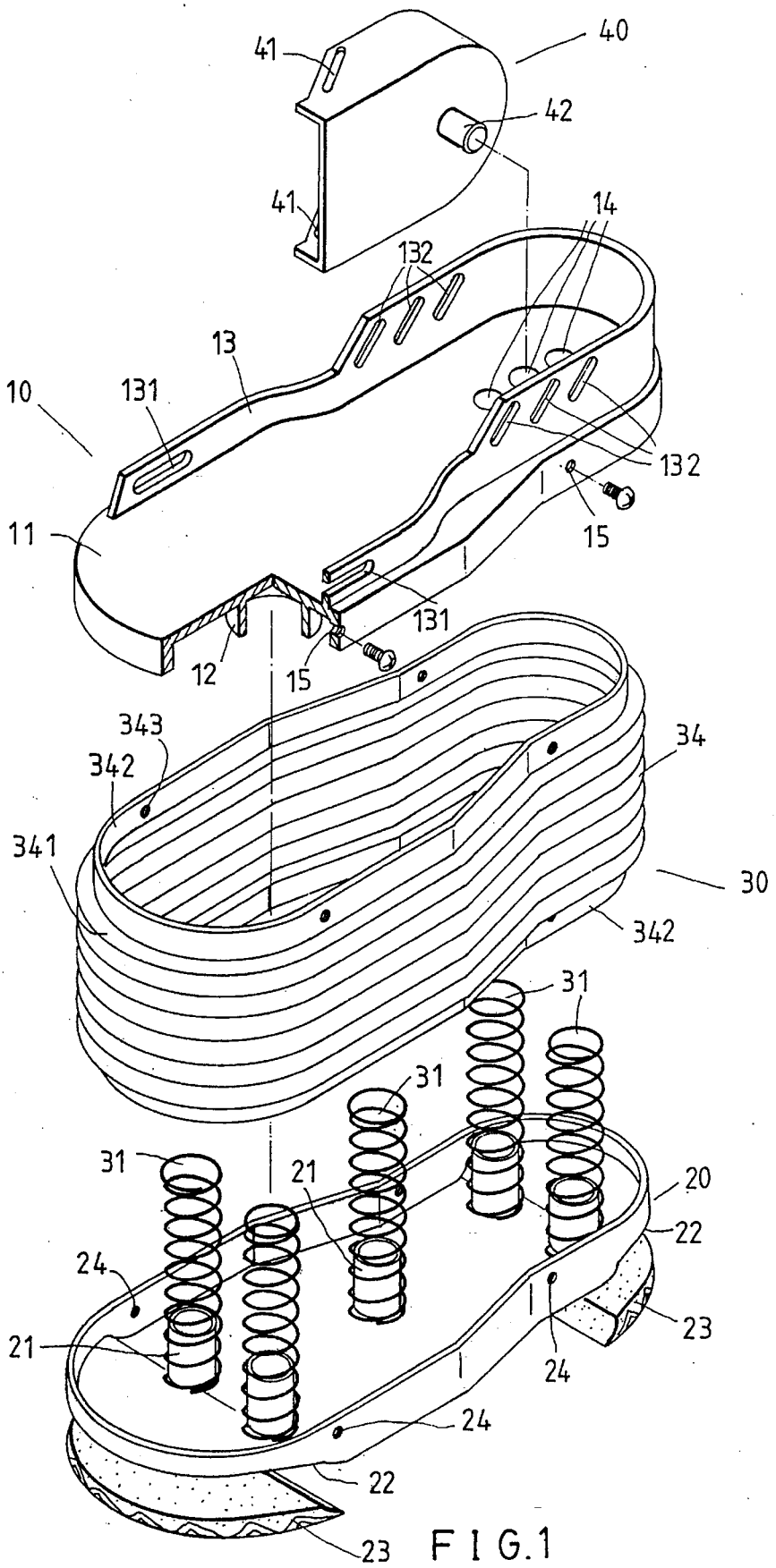
FIG. 1 shows an exploded view of a first preferred embodiment of the present invention.
Figure 2:
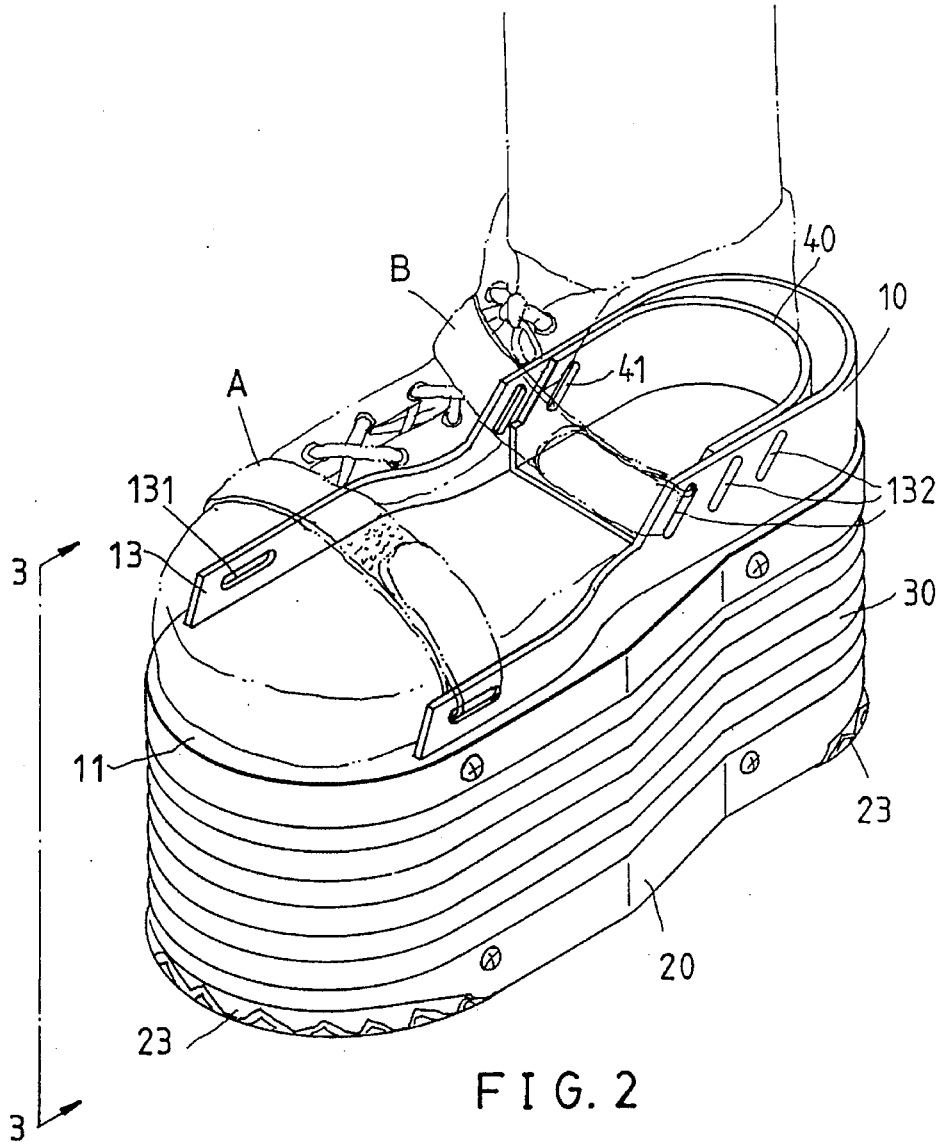
FIG. 2 shows a perspective view of the first preferred embodiment in combination according to the present invention.
Figure 3:
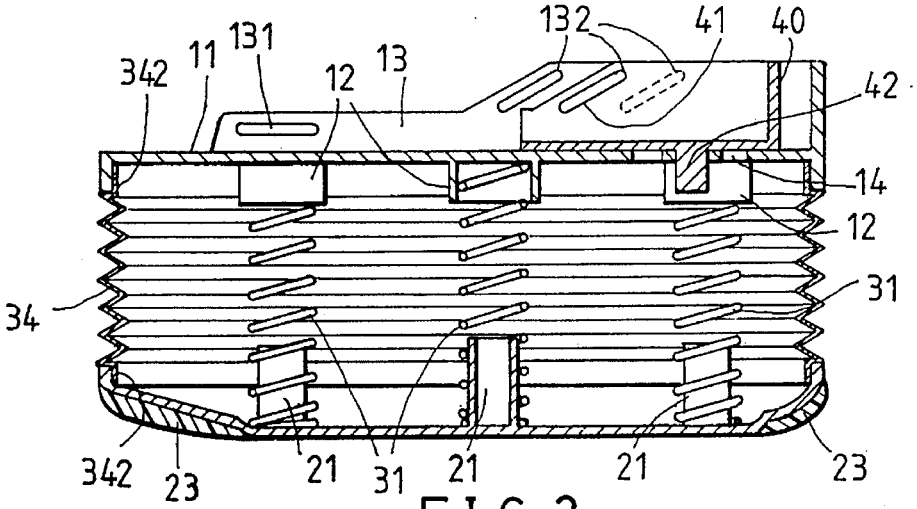
FIG. 3 shows a sectional view of a portion taken along the line 3—3 as shown in FIG. 2.

As shown in FIGS. 1–3, an amusement shoe of the first preferred embodiment of the present invention comprises an insole 10, an outsole 20, a resilient portion 30, and an adjustment piece 40.

The insole 10 is made integrally and is provided with a plate portion 11 which is in turn provided on the underside thereof with five outer fitting portions 12 of a tubular construction. The plate portion 11 is further provided peripherally on the upper side thereof with a U-shaped ring portion 13 which is provided respectively and correspondingly on both sides of the front end thereof with a front retaining hole 131. The U-shaped ring portion 13 is further provided respectively and correspondingly on both sides of the rear end thereof with three first rear retaining holes 132 parallel to one another. The plate portion 11 is provided at the rear end thereof with three first retaining portions 14 which are arranged side by side in a parallel manner and are of a round hole construction. The insole 10 is further provided on the side wall thereof with a plurality of holes 15.

The outsole 20 is made integrally and provided with five tubular inner fitting portions 21 which are corresponding in location and number to the outer fitting portions 12 of the insole 10. The outsole 20 is further provided respectively at the front and the rear ends thereof with a recess 22 which is so dimensioned as to receive therein an anti-skidding piece 23 fastened thereto. The outsole 20 is still further provided on the side wall thereof with a plurality of holes 24.

The resilient portion 30 comprises five coil springs 31 which are fitted respectively over the inner fitting portions 21 of the outsole 20 and the outer fitting portions 12 of the insole 10. The resilient portion 30 further comprises a resilient casing 34 which has an outer wall 341. Located respectively at the upper side and the lower side of the outer wall 341 is an upright inner attaching portion 342 extending outwards. The inner attaching portion 342 is provided with a plurality of threaded holes 343 corresponding in location to the holes 15 of the insole 10 or the holes 24 of the outsole 20. The resilient casing 34 is fastened with the insole 10 by a plurality of bolts engageable with the holes 15 and the threaded holes 343 of the upper attaching portion 342. The resilient casing 34 is further fastened with the outsole 20 by a plurality of bolts engageable with the holes 24 of the outsole 20 and the threaded holes 343 of the lower attaching portion 342.

The adjustment piece 40 is U-shaped in its cross section and is fitted into the rear end portion of the U-shaped ring portion 13 of the insole 10. The adjustment piece 40 is provided respectively on two opposite side walls thereof with a second rear retaining hole 41 and is further provided on the bottom wall thereof with a second retaining portion 42 of a tubular construction and engageable with any one of the first retaining portions 14 of the insole 10.

In combination, the adjustment piece 40 is disposed at the rear end of the ring portion 13 of the insole 10 such that the second retaining portion 42 of the ajustment piece 40 is engaged with one of the first retaining portions 14 of the insole 10, and that the second rear retaining holes 41 of the adjustment piece 40 are corresponding in location to the first rear retaining holes 132 of the insole 10. As shown in FIG. 2, a foot is secured to the shoe of the present invention by a front fastening strap A and a rear fastening strap B. The front fastening strap A is held securely in the front retaining holes 131 of the insole 10 while the rear fastening strap B is held securely in the first rear retaining holes 132 of the the insole 10 and the second rear retaining holes 41 of the adjustment piece 40. The position of the adjustment piece 40 can be so adjusted as to allow persons having different foot sizes to wear the shoe. The position adjustment of the adjustment piece 40 can be done easily by relocating manually the adjustment piece 40 such that the second retaining portion 42 of the adjustment piece 40 is engaged with another first retaining portion 14 of the insole 10.

The bouncing effect of the shoe of the present invention is brought about by the coil springs 31 of the resilient portion 30. The shoe of the present invention enables its wearer to do a stable jumping motion, thanks to the anti-skidding pieces 23 of the outsole 20, which are made of a soft material and are deformable upon making contact with the ground so as to provide the outsole 20 with a better control area for mitigating the inertia impulse of a human body in motion. It must be noted here that the coil springs 31 of the resilient portion 30 may be replaced with a plurality of inflatable air sacs.

Figure 4:
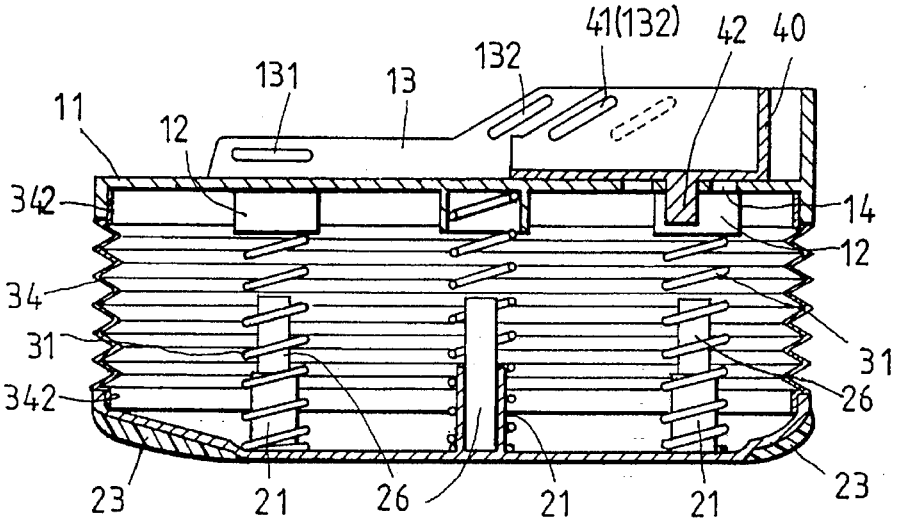
FIG. 4 shows a sectional view of a second preferred embodiment in combination according to the present invention.

As shown in FIG. 4, the second preferred embodiment of the present invention comprises the outsole 20 which is provided with a plurality of inner fitting portions 21 of a tubular construction. The inner fitting portions 21 are provided therein respectively with a cushioning rod 26 for regulating the compression of the coil spring 31 and providing the cushioning effect.

Figure 5:
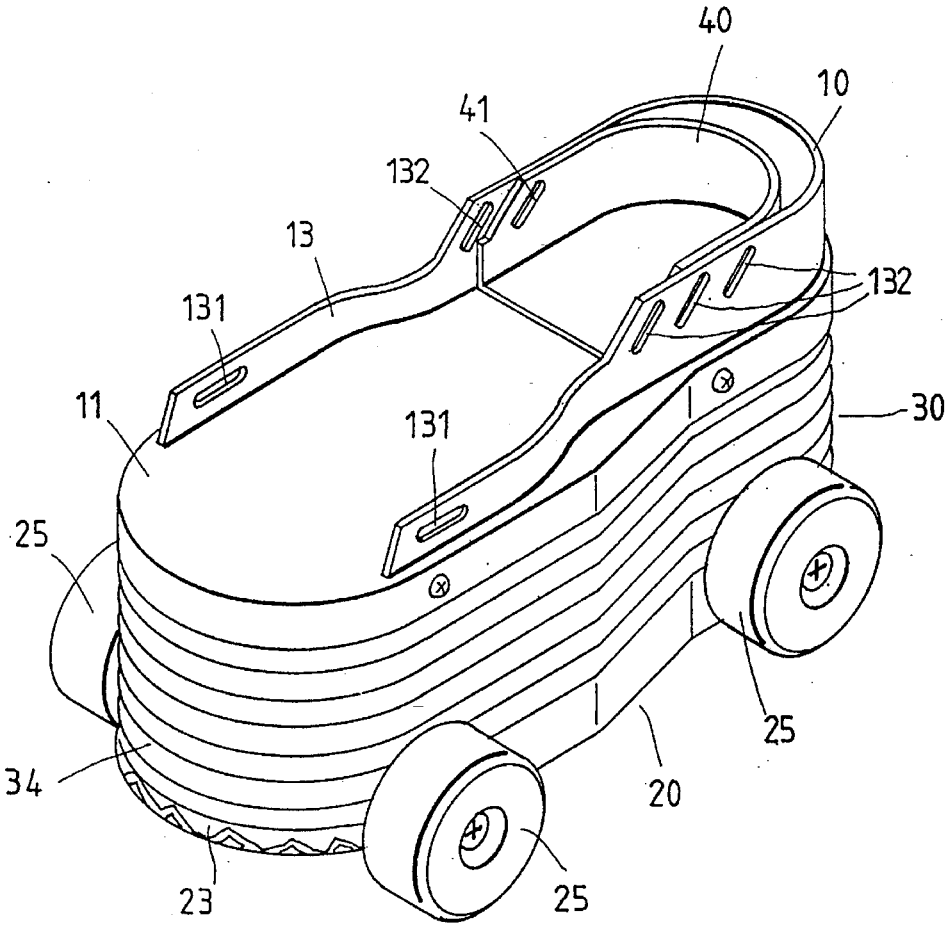
FIG. 5 shows a perspective view of a third preferred embodiment in combination according to the present invention.

As shown in FIG. 5, the third preferred embodiment of the present invention comprises four wheels 25 which are fastened with the outsole 20 to allow a person to coast on the shoe.

The shoe of the present invention is unique in that it fits all foot sizes, and that the adjustment piece 40 can be relocated easily without the use of a hand tool, and further that the outsole 20 is provided with two anti-skidding means capable of preventing the skidding of the outsole 20 and of providing the outsole 20 with the cushioning effect.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An amusement footwear comprising an insole, an outsole, and a resilient portion disposed between said insole and said outsole for providing said footwear with a bouncing effect; wherein said insole is provided integrally with a ring portion of a U-shaped construction having an open end corresponding in location to toes of a person's foot, said ring portion provided at said open end thereof with two front retaining holes opposite to each other, said ring portion further provided respectively at both sides of a closed end thereof with a plurality of first rear retaining holes parallel to each other, said insole having a rear end which is corresponding in location to heel of a person's foot and is provided with a plurality of first retaining means engageable with a second retaining means fastened to the underside of a bottom of an adjustment means dimensioned to fit into said rear end of said insole, said adjustment means provided respectively and correspondingly on both side walls thereof with a second rear retaining hole which is corresponding in location to one of said first rear retaining holes of said insole, said insole further provided on an underside thereof with a plurality of outer fitting means; wherein said outsole is provided thereon with a plurality of inner fitting means corresponding in location to said outer fitting means of said insole; and wherein said resilient portion comprises a plurality of coil springs which are fitted at one end thereof over said outer fitting means of said insole and are further fitted at another end thereof over said inner fitting means of said outsole, said resilient portion further comprising a resilient casing fastened securely with said insole and said outsole such that said casing encloses said coil springs.

2. The amusement footwear as defined in claim 1, wherein said outsole is provided respectively on the undersides of a front and a rear ends thereof with an anti-skidding means.

3. The amusement footwear as defined in claim 2, wherein said anti-skidding means is capable of becoming deformed upon making contact with the ground.

4. The amusement footwear as defined in claim 1, wherein said inner fitting means of said outsole are provided therein respectively with a cushioning rod for regulating the compression of said coil springs.

5. The amusement footwear as defined in claim 1, wherein said outsole is provided with a plurality of wheels fastened thereto so as to enable a wearer of said footwear to glide on the ground.

6. The amusement footwear as defined in claim 1, wherein said ring portion of said insole is provided with a front foot-fastening strap held in said front retaining holes of said ring portion and is further provided with a rear foot-fastening strap held in said first rear retaining holes of said ring portion and said second rear retaining holes of said adjustment means.

* * * * *